US010347418B2

(12) United States Patent
Sakuma et al.

(10) Patent No.: US 10,347,418 B2
(45) **Date of Patent: *Jul. 9, 2019**

(54) METHOD OF MANUFACTURING RARE EARTH MAGNET

(71) Applicant: TOYOTA JIDOSHA KABUSHIKI KAISHA, Toyota-shi, Aichi-ken (JP)

(72) Inventors: Noritsugu Sakuma, Toyota (JP); Tetsuya Shoji, Toyota (JP); Daisuke Sakuma, Toyota (JP); Kazuaki Haga, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 18 days.

This patent is subject to a terminal disclaimer.

(21) Appl. No.: 15/104,369

(22) PCT Filed: Dec. 17, 2014

(86) PCT No.: PCT/IB2014/002800

§ 371 (c)(1),
(2) Date: Jun. 14, 2016

(87) PCT Pub. No.: WO2015/092524

PCT Pub. Date: Jun. 25, 2015

(65) Prior Publication Data

US 2016/0314899 A1 Oct. 27, 2016

(30) Foreign Application Priority Data

Dec. 19, 2013 (JP) ..... 2013-262274

(51) Int. Cl.
*H01F 1/057* (2006.01)
*H01F 41/02* (2006.01)
(Continued)

(52) U.S. Cl.
CPC ..... *H01F 41/0266* (2013.01); *B22F 1/0003* (2013.01); *B22F 3/16* (2013.01);
(Continued)

(58) Field of Classification Search
CPC .... H01F 1/057; H01F 1/0577; H01F 41/0266; H01F 41/0293; B22F 1/0003;
(Continued)

(56) References Cited

U.S. PATENT DOCUMENTS 5,387,291 A 2/1995 Kaneko et al.
5,405,455 A 4/1995 Kusunoki et al.
(Continued)

FOREIGN PATENT DOCUMENTS

CN 102308343 A 1/2012
CN 103098155 A 5/2013
(Continued)

OTHER PUBLICATIONS

Office Action dated Dec. 11, 2017 from U.S. Patent & Trademark Office in counterpart U.S. Appl. No. 15/107,603.
(Continued)

*Primary Examiner* — Colleen P Dunn
*Assistant Examiner* — Anthony M Liang
(74) *Attorney, Agent, or Firm* — Sughrue Mion, PLLC

(57) ABSTRACT

A method includes: manufacturing a sintered compact represented by $(Rl)_x(Rh)_yT_zB_sM_t$ and has a grain boundary phase; manufacturing a rare earth magnet precursor from the sintered compact; and performing a heat treatment on the rare earth magnet precursor at 450° C. to 700° C. to diffuse and to infiltrate a melt of a modified alloy containing a light rare earth element and either a transition metal element, Al, In, Zn, or Ga into the grain boundary phase. Rl represents a light rare earth element. Rh represents Dy or Tb. T represents a transition metal containing at least one of Fe, Ni, and
(Continued)

Co. B represents boron. M represents at Ga, Al, or Cu. x, y, z, s, and t represent mass % of Rl, Rh, T, B, and M. Following expressions are established: $27 \leq x \leq 44$, $0 \leq y \leq 10$, $z=100-x-y-s-t$, $0.75 \leq s \leq 3.4$, $0 \leq t \leq 3$. An infiltration amount of the modified alloy is 0 mass % to 5 mass %.

5 Claims, 10 Drawing Sheets

(51) Int. Cl.

| | |
|---|---|
| ***B22F 1/00*** | (2006.01) |
| ***B22F 3/16*** | (2006.01) |
| ***C22C 38/00*** | (2006.01) |
| ***C22C 38/06*** | (2006.01) |
| ***C22C 38/16*** | (2006.01) |
| *B22F 3/24* | (2006.01) |

(52) U.S. Cl.
CPC ..... *C22C 38/002* (2013.01); *C22C 38/005* (2013.01); *C22C 38/06* (2013.01); *C22C 38/16* (2013.01); *H01F 1/057* (2013.01); *H01F 1/0577* (2013.01); *H01F 41/0293* (2013.01); *B22F 2003/248* (2013.01)

(58) Field of Classification Search
CPC .... B22F 2003/248; B22F 3/16; C22C 38/002; C22C 38/005; C22C 38/06; C22C 38/16
See application file for complete search history.

(56) References Cited

U.S. PATENT DOCUMENTS

| | | | |
|---|---|---|---|
| 2010/0003156 | A1 | 1/2010 | Suzuki et al. |
| 2010/0233016 | A1 | 9/2010 | Tsubokura et al. |
| 2011/0286878 | A1 | 11/2011 | Kishimoto et al. |
| 2013/0078369 | A1 | 3/2013 | Shoji et al. |
| 2013/0248754 | A1 | 9/2013 | Sakuma et al. |
| 2013/0323111 | A1 | 12/2013 | Miyamoto et al. |
| 2014/0242267 | A1 | 8/2014 | Shoji et al. |
| 2016/0314899 | A1 | 10/2016 | Sakuma et al. |

FOREIGN PATENT DOCUMENTS

| | | | |
|---|---|---|---|
| CN | 103189943 | A | 7/2013 |
| CN | 104979062 | A | 10/2015 |
| CN | 105118593 | A | 12/2015 |
| CN | 105679482 | A | 6/2016 |
| CN | 105845306 | A | 8/2016 |
| JP | 5-267027 | A | 10/1993 |
| JP | 06-207203 | A | 7/1994 |
| JP | 2853839 | B2 | 11/1998 |
| JP | 2010-263172 | A | 11/2010 |
| JP | 2011-216659 | A | 10/2011 |
| JP | 2012-244111 | A | 12/2012 |
| JP | 2013-149862 | A | 8/2013 |
| WO | 2012/008623 | A1 | 1/2012 |
| WO | 2012/036294 | A1 | 3/2012 |
| WO | 2012/114530 | A1 | 8/2012 |
| WO | 2013/072728 | A1 | 5/2013 |
| WO | 2013/073486 | A1 | 5/2013 |

OTHER PUBLICATIONS

U.S. Advisory Action dated Aug. 6, 2018, issued by USPTO in U.S. Appl. No. 15/107,603.
Final Office Action dated Apr. 27, 2018, issued by the US Patent & Trademark Office in U.S. Appl. No. 15/107,603.
Notice of Allowance dated Nov. 15, 2018, which issued during the prosecution of U.S. Appl. No. 15/107,603.

(COMPARATIVE EXAMPLE 1)

(COMPARATIVE EXAMPLE 2)

(COMPARATIVE EXAMPLE 3)

(EXAMPLE 1)

(EXAMPLE 2)

(EXAMPLE 3)

(EXAMPLE 4)

METHOD OF MANUFACTURING RARE EARTH MAGNET

BACKGROUND OF THE INVENTION

1. Field of the Invention

The present invention relates to a method of manufacturing a rare earth magnet.

2. Description of Related Art

Rare earth magnets made from rare earth elements are called permanent magnets and are used for driving motors of hybrid vehicles, electric vehicles, and the like, as well as motors included in hard disks and MRIs.

As an index indicating magnet performance of these rare earth magnets, for example, remanent magnetization (remanent magnetic flux density) and coercive force may be used. Along with a decrease in the size of a motor and an increase in current density, the amount of heat generation increases; and thus the demand for high heat resistance has further increased in rare earth magnets to be used. Accordingly, one of the important research issues in this technical field is how to hold the coercive force of a magnet when being used at a high temperature. A Nd—Fe—B-based magnet which is a rare earth magnet widely used in a vehicle driving motor will be described as an example. In this Nd—Fe—B-based magnet, an attempt to increase the coercive force thereof has been made, for example, by refining crystal grains, by using an alloy composition having a large amount of Nd, or by adding a heavy rare earth element such as Dy or Tb having high coercive force performance.

Examples of the rare earth magnets include commonly-used sintered magnets in which a grain size of crystal grains constituting a structure thereof is about 3 μm to 5 μm; and nanocrystalline magnets in which crystal grains are refined into a nano grain size of about 50 nm to 300 nm.

In order to improve the coercive force among magnetic properties of such a rare earth magnet, PCT International Publication WO 2012/008623 discloses a method in which, for example, a Nd—Cu alloy or a Nd—Al alloy is diffused and infiltrated into a grain boundary phase as a modified alloy containing a transition metal element or the like and a light rare earth element to modify the grain boundary phase.

Since the modified alloy containing a transition metal element or the like and a light rare earth element does not contain a heavy rare earth element such as Dy, the modified alloy has a low melting point, is melted even at about 700° C., and can be diffused and infiltrated into the grain boundary phase. Accordingly, in the case of nanocrystalline magnets having a grain size of about 300 nm or less, it can be said that the above processing method is preferable because coercive force performance can be improved by modifying the grain boundary phase while suppressing the coarsening of crystal grains.

However, when the Nd—Cu alloy or the like is diffused and infiltrated into the grain boundary phase, in order for the Nd—Cu alloy or the like to be diffused and infiltrated into the center of the magnet, it is necessary that the infiltration amount of the Nd—Cu alloy or the like or the heat treatment time be increased.

In this case, the Nd—Cu alloy itself is a non-magnetic alloy, and thus when the infiltration amount of the Nd—Cu alloy or the like to be diffused and infiltrated is increased, the content of a non-magnetic alloy in the magnet is increased, which leads to a decrease in the remanent magnetization of the magnet. In addition, an increase in the infiltration amount of the Nd—Cu alloy or the like causes an increase in material cost.

In addition, the diffusion and infiltration of the Nd—Cu alloy or the like using a long-term heat treatment leads to an increase in the manufacturing time and cost of a magnet.

On the other hand, instead of the diffusion and infiltration of the modified alloy, PCT International Publication WO 2012/036294 discloses a method of manufacturing a rare earth magnet in which a heat treatment is performed on a rare earth magnet precursor subjected to hot deformation processing at a temperature, which is sufficiently high for causing a grain boundary phase to be diffused or flow and is sufficiently low for preventing the coarsening of crystal grains, such that a grain boundary phase concentrated on triple points of crystal grains is sufficiently infiltrated into a grain boundary other than the triple points to cover each crystal grain, thereby improving coercive force performance. Such a heat treatment may be also called an optimal heat treatment or an aging treatment.

The low temperature during the heat treatment defined herein is about 700° C. at the highest as in the case of PCT International Publication WO 2012/008623. In order to cause the grain boundary phase to be diffused or flow at such a low temperature, a rare earth magnet composition is represented by, for example, $Nd_{15}Fe_{77}B_7Ga$, and a rare earth magnet is manufactured from a composition material having a Nd-rich grain boundary.

However, in the manufacturing method disclosed in PCT International Publication WO 2012/036294, the modified alloy is not diffused and infiltrated. Therefore, in terms of the coercive force performance of, for example, a surface region (outer peripheral region) of a magnet, deterioration in coercive force performance is inevitable as compared to the case of the manufacturing method in which the modified alloy is diffused and infiltrated.

Therefore, a simple combination between the above-described two techniques may be considered, the techniques including: the technique disclosed in PCT International Publication WO 2012/008623, that is, the manufacturing method in which the modified alloy is diffused and infiltrated; and the technique disclosed in PCT International Publication WO 2012/036294, that is, the manufacturing method in which a grain boundary phase is caused to, for example, flow by a heat treatment at a low temperature. According to a manufacturing method which is a combination of the above related techniques, it is considered that the coercive force of a surface region of a magnet can be improved by the diffusion and infiltration of the modified alloy, and the coercive force of a center region of the magnet can be improved by the flow or the like of a grain boundary phase.

However, PCT International Publication WO 2012/008623 and PCT International Publication WO 2012/036294 mainly focus on the improvement of coercive force performance and do not have a configuration relating to the above-described problem, that is, a decrease in remanent magnetization which is caused when the infiltration amount of the modified alloy is excessively large. Therefore, with the simple combination between the techniques disclosed in PCT International Publication WO 2012/008623 and PCT International Publication WO 2012/036294, a method of manufacturing a rare earth magnet which is superior in both coercive force performance and magnetization performance cannot be obtained.

SUMMARY OF THE INVENTION

The present invention has been made to provide a method of manufacturing a rare, earth magnet, the method being capable of manufacturing a rare earth magnet which is superior in both coercive force performance and magnetization performance.

According to an aspect of the invention, there is provided a method of manufacturing a rare earth magnet including: manufacturing a sintered compact which has a composition represented by $(Rl)_x(Rh)_yT_zB_sM_t$ and has a structure including a main phase and a grain boundary phase; manufacturing a rare earth magnet precursor by performing hot deformation processing on the sintered compact; and manufacturing a rare earth magnet by performing a heat treatment on the rare earth magnet precursor in a temperature range of 450° C. to 700° C. so as to diffuse and to infiltrate a melt of a modified alloy into the grain boundary phase of the rare earth magnet precursor, the modified alloy containing a light rare earth element and one of a transition metal element, Al, In, Zn, and Ga. Rl represents one of light rare earth elements containing Y. Rh represents at least one of heavy rare earth elements selected from the group consisting of Dy and Tb. T represents a transition metal containing at least one of Fe, Ni, and Co. B represents boron. M represents at least one of Ga, Al, and Cu. x, y, z, s, and t respectively represent percentages by mass of Rl, Rh, T, B, and M in the sintered compact. x, y, z, s, and t are expressed by the following expressions: $27 \leq x \leq 44$, $0 \leq y \leq 10$, $z=100-x-y-s-t$, $0.75 \leq s \leq 3.4$, $0 \leq t \leq 3$. An infiltration amount of the melt of the modified alloy infiltrated into the grain boundary phase is more than 0 mass % and less than 5 mass % with respect to the rare earth magnet precursor.

In the method of manufacturing a rare earth magnet, the grain boundary phase contains at least one of Ga, Al, and Cu in addition Nd or the like, and the modified alloy containing a light rare earth element and one of a transition metal element, Al, In, Zn, and Ga is diffused and infiltrated in an infiltration amount of more than 0 mass % and less than 5 mass % with respect to the rare earth magnet precursor. As a result, a decrease in magnetization caused by the diffusion and infiltration of the modified alloy is suppressed, and the coercive force performance of the entire region of a magnet ranging from a center region to a surface region thereof is improved. Here, a boundary between the center region and the surface region is not particularly limited. For example, when the distance from the surface to the center of a magnet is represented by a, a depth of a/3 and a depth of 2a/3 may be defined as a center region and a surface region, respectively.

Here, the rare earth magnet which is a manufacturing target of the manufacturing method according to the aspect of the invention includes a nanocrystalline magnet in which a grain size of a main phase (crystal) constituting a structure thereof is about 300 nm or less; a sintered magnet having a grain size of more than 300 nm or a grain size of 1 μm or more; and a bonded magnet in which crystal grains are bonded through a binder resin.

In the method according to the aspect, first, magnetic powder which is represented by the above-described composition and has a structure including the main phase and the grain boundary phase is manufactured. For example, magnetic powder for a rare earth magnet may be prepared by preparing a rapidly-solidified ribbon, which is fine crystal grains, by rapid solidification and crushing the rapidly-solidified ribbon.

This magnetic powder is filled into, for example, a die and is sintered while being compressed by a punch to be bulked. As a result, an isotropic sintered compact is obtained. This sintered compact has, for example, a metallographic structure that includes a RE-Fe—B main phase of a nanocrystalline structure and a grain boundary phase of an RE-X alloy (X: metal element) present around the main phase. Here, RE represents at least one of Nd and Pr, and more specifically, one element or two or more elements selected from Nd, Pr, and Nd—Pr. The grain boundary phase contains at least one of Ga, Al, and Cu in addition to Nd or the like.

Next, hot deformation processing is performed on the isotropic sintered compact to impart magnetic anisotropy thereto. Examples of the hot deformation processing include upset forging and extrusion forging (forward extrusion forging and backward extrusion forging). A processing strain is introduced into the sintered compact by using one method or a combination of two or more methods among the above-described hot deformation processing methods. Next, for example, high deformation is performed at a processing rate of 60% to 80%. As a result, a rare earth magnet having high orientation and superior magnetization performance is manufactured.

According to the aspect of the invention, a rare earth magnet precursor which is an oriented magnet is manufactured by performing hot deformation processing on the sintered compact. Next, a rare earth magnet is manufactured by performing a heat treatment on the rare earth magnet precursor in a temperature range of 450° C. to 700° C. so as for a melt of a modified alloy to be diffused and infiltrated into the grain boundary phase of the rare earth magnet precursor. Here, the modified alloy contains a light rare earth element and either a transition metal element or the like.

The grain boundary phase between crystals constituting the rare earth magnet precursor contains at least one of Ga, Al, and Cu in addition to Nd or the like. Accordingly, during the heat treatment in which the modified alloy is diffused and infiltrated, the heat treatment is performed even on the inside of the rare earth magnet precursor. Due to this heat treatment, Nd or the like and Ga, Al, Cu, or the like in the grain boundary phase are alloyed. The grain boundary phase is modified by this alloy. That is, by alloying a transition metal element or the like and a light rare earth element contained in the grain boundary phase in advance, the same modification effects as in the case where the modified alloy is diffused and infiltrated can be exhibited without the necessity of diffusing and infiltrating the modified alloy into the surface of a magnet.

In addition, due to the diffusion and infiltration of the modified alloy, the grain boundary phase of the surface region of the rare earth magnet precursor in which the modified alloy is easily diffused and infiltrated is modified. The modification of the grain boundary phase, which is performed by alloying a transition metal element or the like and a light rare earth element present in the grain boundary phase in advance, is performed on the grain boundary phase of the entire region of the rare earth magnet precursor. Accordingly, the modification of the grain boundary phase can be sufficiently performed on a center region of the rare earth magnet precursor without the necessity of diffusing and infiltrating the modified alloy into the center region.

In the method of manufacturing a rare earth magnet according to the aspect of the invention, a modified alloy having a melting point or an eutectic point in the temperature range of 450° C. to 700° C. may be an alloy containing a light rare earth element such as Nd or Pr and an element such as Cu, Co, Mn, In, Zn, Al, Ag, Ga, or Fe.

According to the verification of the present inventors regarding the infiltration amount of the modified alloy, it is specified that, when the content of the modified alloy is 5 mass % or higher with respect to a rare earth magnet precursor to be diffused and infiltrated, the remanent magnetization is excessively decreased to be less than a target value of the present inventors. Therefore, the infiltration amount of the modified alloy is defined to be less than 5 mass % with respect to the rare earth magnet precursor.

In addition, in the method of manufacturing a rare earth magnet according to the aspect of the invention, a holding time during the heat treatment may be 5 minutes to 3 hours.

As described above, the modification of the grain boundary phase, which is performed by alloying a transition metal element or the like and a light rare earth element present in the grain boundary phase in advance, is performed on the grain boundary phase of the entire region of the rare earth magnet precursor. Therefore, it is not necessary to diffuse and infiltrate the modified alloy into the center region of the magnet. As a result, the holding time during the heat treatment can be reduced to be 5 minutes to 3 hours as compared to a holding time of the related techniques in which the modified alloy is diffused and infiltrated.

In the method of manufacturing a rare earth magnet according to the aspect of the invention, the holding time during the heat treatment may be 30 minutes to 3 hours. According to the verification of the present inventors, regarding the holding time during the heat treatment, it is specified that a curve indicating a relationship between the holding time and the coercive force has an inflection point at the lower limit of 5 minutes. On the other hand, it is also specified that a holding time at which the coercive force reaches a peak value is about 30 minutes. Accordingly, when only coercive force performance is taken into consideration, the holding time may be 30 minutes or longer. It is also specified that the remanent magnetization tends to be slightly gradually decrease according to the holding time during the heat treatment. When the above facts and the fact that a short-term heat treatment leads to improvement in manufacturing efficiency are taken into consideration together, the holding time during the heat treatment may be 30 minutes to 3 hours.

As described above, in the method of manufacturing a rare earth magnet according to the aspect of the invention, the grain boundary phase contains at least one of Ga, Al, and Cu in addition to a light rare earth element such as Nd. In addition, the infiltration amount of the modified alloy containing a light rare, earth element and one of a transition metal element, Al, In, Zn, and Ga is defined to be more than 0 mass % and less than 5 mass % with respect to the rare earth magnet precursor, and the heat treatment temperature is defined to be 450° C. to 700° C. In the method of manufacturing a rare earth magnet according to the aspect of the invention, the coercive force of the entire region of a magnet can be improved while suppressing a, decrease in remanent magnetization, and a rare earth magnet which is superior in both magnetization performance and coercive force performance can be manufactured.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS (Method of Manufacturing Rare Earth Magnet)

Figure 1A:
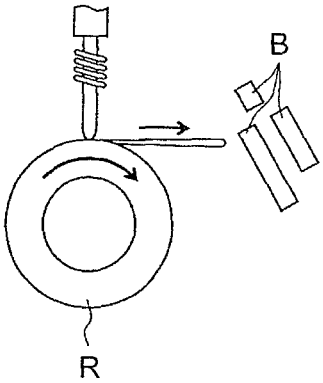
FIGS. 1A and 1B are schematic diagrams sequentially illustrating a first step of a method of manufacturing a rare earth magnet according to an embodiment of the invention.
Figure 1B:
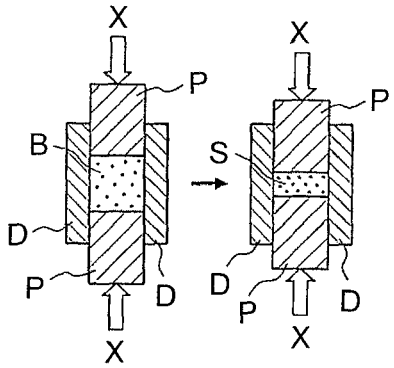
Figure 1C:
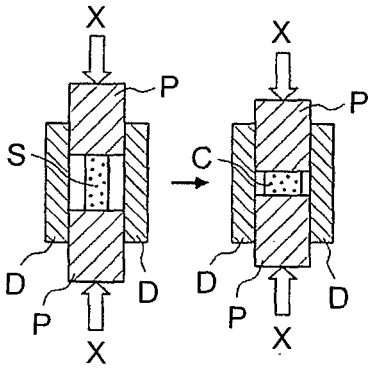
FIG. 1C is a schematic diagram illustrating a second step thereof.
Figure 2A:
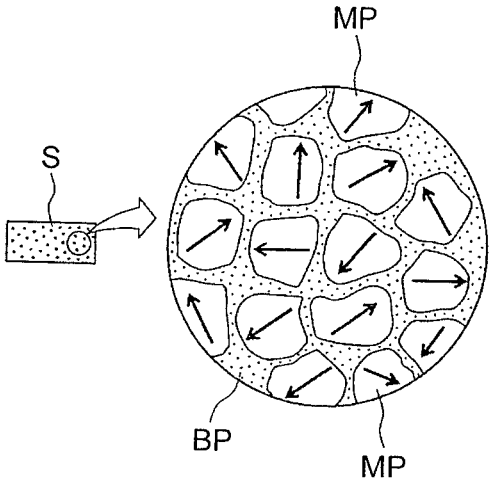
FIG. 2A is a diagram illustrating a microstructure of a sintered compact illustrated in FIG. 1B.
Figure 2B:
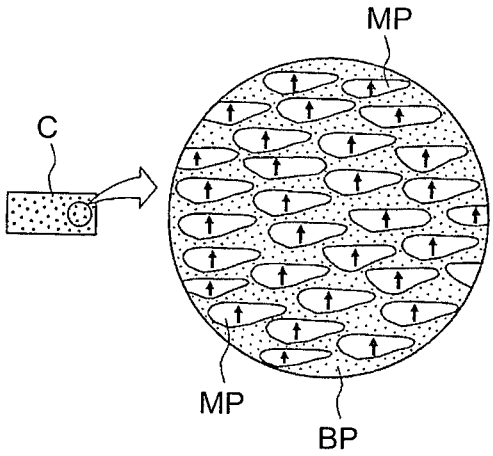
FIG. 2B is a diagram illustrating a microstructure of a rare earth magnet precursor illustrated in FIG. 1C.
Figure 3:
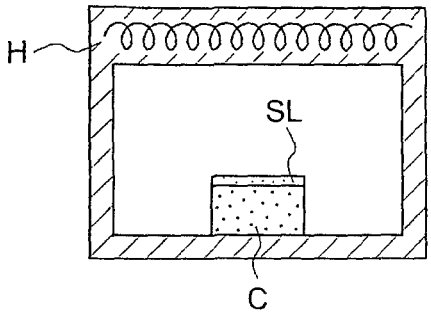
FIG. 3 is a schematic diagram illustrating a third step of the method of manufacturing a rare earth magnet according to the embodiment of the invention.
Figure 4:
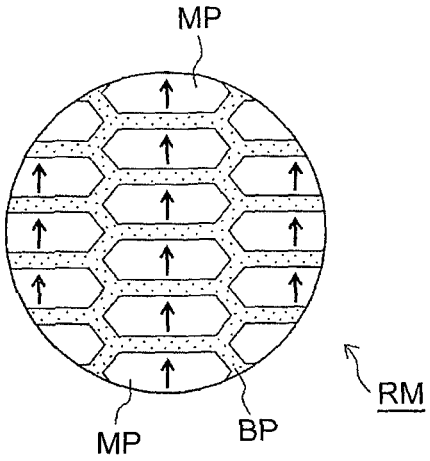
FIG. 4 is a diagram illustrating a microstructure of a crystal structure of the manufactured rare earth magnet.

FIGS. 1A and 1B are schematic diagrams sequentially illustrating a first step of a method of manufacturing a rare earth magnet according to an embodiment of the invention, and FIG. 1C is a schematic diagram illustrating a second step thereof. In addition, FIG. 3 is a schematic diagram illustrating a third step of the method of manufacturing a rare earth magnet. In addition, FIG. 2A is a diagram illustrating a microstructure of a sintered compact illustrated in FIG. 1B, and FIG. 2B is a diagram illustrating a microstructure of a rare earth magnet precursor illustrated in FIG. 1C. Further, FIG. 4 is a diagram illustrating a microstructure of a crystal structure of the manufactured rare earth magnet.

As illustrated in FIG. 1A, in a furnace (not illustrated) of an Ar gas atmosphere in which the pressure is reduced to, for example, 50 kPa or less, an alloy ingot is melted by high-frequency induction heating using a single-roll melt spinning method, and molten metal is injected to a copper roll R to prepare a rapidly-solidified ribbon B, and this rapidly-solidified ribbon B is crushed. Here, the molten metal has a composition constituting a rare earth magnet.

As illustrated in FIG. 1B, the crushed rapidly-solidified ribbon B is filled into a cavity which is partitioned by a cemented carbide die D and a cemented carbide punch P sliding in a hollow portion of the cemented carbide die D. Next, the crushed rapidly-solidified ribbon B is heated by causing a current to flow therethrough in a compression direction while being compressed with the cemented carbide punch P (X direction). As a result, a sintered compact S having a composition represented by $(Rl)_x(Rh)_yT_zB_sM_t$ is manufactured. Here, Rl represents one of light rare earth elements containing Y. Rh represents at least one of heavy rare earth elements selected from the group consisting of Dy and Tb. T represents a transition metal containing at least one of Fe, Ni, and Co. B represents boron. M represents at least one of Ga, Al, and Cu. x, y, z, s, and t respectively represent percentages by mass of Rl, Rh, T, B, and M in the sintered compact. x, y, z, s, and t are expressed by the following expressions: $27 \leq x \leq 44$, $0 \leq y \leq 10$, $z=100-x-y-s-t$, $0.75 \leq s \leq 3.4$, $0 \leq t \leq 3$.

The sintered compact S has a structure including a main phase and a grain boundary phase, and the main phase has a grain size of about 50 nm to 300 nm (hereinabove, the first step).

The grain boundary phase contains at least one of Ga, Al, and Cu in addition to Nd or the like and is in a Nd-rich state.

As illustrated in FIG. 2A, the sintered compact S has an isotropic crystal structure in which a grain boundary phase BP is filled between nanocrystalline grains MP (main phase). In order to impart magnetic anisotropy to the sintered compact S, as illustrated in FIG. 1C, the cemented carbide punch P is brought into contact with an end surface of the sintered compact S in a longitudinal direction thereof (in FIG. 1B, the horizontal direction is the longitudinal direction) such that hot deformation processing is performed on the sintered compact S while being compressed with the cemented carbide punch P (X direction). As a result, a rare earth magnet precursor C which includes a crystal structure having the anisotropic nanocrystalline grains MP as illustrated in FIG. 2B is manufactured (hereinabove, the second step).

When the processing degree (compressibility) by the hot deformation processing is high, for example, when the compressibility is about 10% or higher, this processing may be called high hot deformation or simply high deformation. However, it is preferable that high deformation be performed at a compressibility of about 60% to 80%.

In a crystal structure of the rare earth magnet precursor C illustrated in FIG. 2B, the nanocrystalline grains MP have a flat shape, and the boundary surface which is substantially parallel to an anisotropic axis is curved to be bent and is not configured of a specific surface.

Next, as illustrated in FIG. 3, in the third step, modified alloy powder SL is sprayed on the surface of the rare earth magnet precursor C, and the rare earth magnet precursor C is put into a high-temperature furnace H and is held in a high-temperature atmosphere for a predetermined holding time. As a result, a melt of the modified alloy SL is diffused and infiltrated into the grain boundary phase of the rare earth magnet precursor C. Regarding the modified alloy powder SL, a plate-shaped modified alloy powder may be placed on the surface of the rare earth magnet precursor, or a slurry of the modified alloy powder may be prepared and coated on the surface of the rare earth magnet precursor.

Here, the modified alloy powder SL contains a light rare earth element and either a transition metal element or AL, and a modified alloy having a low eutectic point of 450° C. to 700° C. is used. As the modified alloy powder SL, any one of a Nd—Cu alloy (eutectic point: 520° C.), a Pr—Cu alloy (eutectic point: 480° C.), a Nd—Pr—Cu alloy, a Nd—Al alloy (eutectic point: 640° C.), a Pr—Al alloy (eutectic point: 650° C.), a Nd—Pr—Al alloy, a Nd—Co alloy (eutectic point: 566° C.), a Pr—Co alloy (eutectic point: 540° C.), and a Nd—Pr—Co alloy is preferably used. Among these, alloys having an eutectic point of 580° C. or lower, for example, a Nd—Cu alloy (eutectic point: 520° C.), a Pr—Cu alloy (eutectic point: 480° C.), a Nd—Co alloy (eutectic point: 566° C.), and a Pr—Co alloy (eutectic point: 540° C.) are more preferably used.

Heat treatment conditions in the high-temperature furnace H are a temperature range of 450° C. to 700° C. and a holding time of 5 minutes to 3 hours. In addition, the infiltration amount of the melt of the modified alloy SL is more than 0 mass % and less than 5 mass % with respect to the rare earth magnet precursor C.

The grain boundary phase BP between crystals MP constituting the rare earth magnet precursor C contains at least one of Ga, Al, and Cu in addition to rich Nd or the like. Accordingly, during the heat treatment in which the modified alloy is diffused and infiltrated, the heat treatment is performed even on the center region of the rare earth magnet precursor C. Due to this heat treatment, Nd and Ga, Al, Cu, or the like in the grain boundary phase BP are alloyed. The grain boundary phase BP is modified by this alloy (aging treatment, optimization treatment). That is, by alloying a transition metal element or the like and a light rare earth element contained in the grain boundary phase in advance, the same modification effects as in the case where the modified alloy is diffused and infiltrated can be exhibited without the necessity of diffusing and infiltrating the modified alloy into the surface of the rare earth magnet precursor C.

In this way, in order to improve the coercive force of the center region of the rare earth magnet precursor C, it is not necessary to diffuse and infiltrate the modified alloy. Accordingly, it is sufficient that the modified alloy SL be diffused and infiltrated into only the surface region of the rare earth magnet precursor C. Therefore, the holding time during the heat treatment is 5 minutes to 3 hours, preferably 30 minutes to 3 hours, more preferably 30 minutes to 60 minutes, and still more preferably 30 minutes.

In addition, due to the diffusion and infiltration of the modified alloy SL, the grain boundary phase BP of the surface region of the rare earth magnet precursor C in which the modified alloy SL is easily diffused and infiltrated is modified. As described above, the modification of the grain boundary phase BP, which is performed by alloying a transition metal element or the like and a light rare earth element present in the grain boundary phase BP in advance, is performed on the grain boundary phase BP of the entire region of the rare earth magnet precursor C. Accordingly, the modification of the grain boundary phase BP can be sufficiently performed on a center region of the rare earth magnet precursor C without the necessity of diffusing and infiltrating the modified alloy into the center region.

In addition, regarding the infiltration amount of the modified alloy SL, when the content of the modified alloy SL is 5 mass % or more with respect to the rare earth magnet precursor C to be diffused and infiltrated, the remanent magnetization is excessively decreased. Therefore, the infiltration amount of the modified alloy SL is defined to be less than 5 mass % with respect to the rare earth magnet precursor.

The melt of the modified alloy SL is diffused and infiltrated into the grain boundary phase BP of the surface region of the rare earth magnet precursor C, and Nd or the like and at least one of Ga, Al, and Cu present in the grain boundary phase in advance are alloyed in the center region of the rare earth magnet precursor C. As a result, the grain boundary phase BP is modified. Accordingly, the crystal structure of the rare earth magnet precursor C illustrated in FIG. 2B is changed, the boundary surface of the crystal grains MP is cleared as illustrated in FIG. 4, the crystal grains MP are magnetically isolated from each other, and a rare earth magnet RM having an improved coercive force is manufactured (third step). In an intermediate step of the structure modification by the modified alloy illustrated in FIG. 4, a boundary surface which is substantially parallel to an anisotropic axis is not formed (is not configured of a specific surface). However, in a step in which the modification by the modified alloy sufficiently progresses, a boundary surface (specific surface) which is substantially parallel to an anisotropic axis is formed, and a rare earth magnet in which the shape of the crystal grains MP is rectangular or substantially rectangular when seen from a direction perpendicular to the anisotropic axis is manufactured.

In the method of manufacturing a rare earth magnet illustrated in the drawings, the grain boundary phase BP contains at least one of Ga, Al, and Cu in addition to Nd or the like. In addition, the infiltration amount of the modified alloy SL containing a light rare earth element and a transition metal element and the like is defined to be more than 0 mass % and less than 5 mass % with respect to the rare earth magnet precursor C. The heat treatment temperature is defined to be 450° C. to 700° C., and the heat treatment holding time is defined to be 5 minutes to 3 hours. In the method of manufacturing a rare earth magnet, the coercive force of the entire region of a magnet can be improved while suppressing a decrease in remanent magnetization, and a rare earth magnet which is superior in both magnetization performance and coercive force performance can be manufactured.

[Experiment for Verifying Magnetic Properties of Rare Earth Magnets Manufactured Using Manufacturing Method of Related Art and Manufacturing Method According to Invention, and Results Thereof]

The present inventors performed an experiment of measuring coercive force and remanent magnetization, which were magnetic properties, regarding rare earth magnets (Comparative Examples 1 to 3) manufactured using the manufacturing method of the related art and rare earth magnets (Examples 1 to 5) manufactured using the manufacturing method according to the invention. Regarding the coercive force, a surface coercive force and a center coercive force of a test piece was measured. Regarding the remanent magnetization, a surface remanent magnetization and a center remanent magnetization of a test piece were measured, and an average remanent magnetization thereof was specified.

Examples 1 to 5

Figure 5:
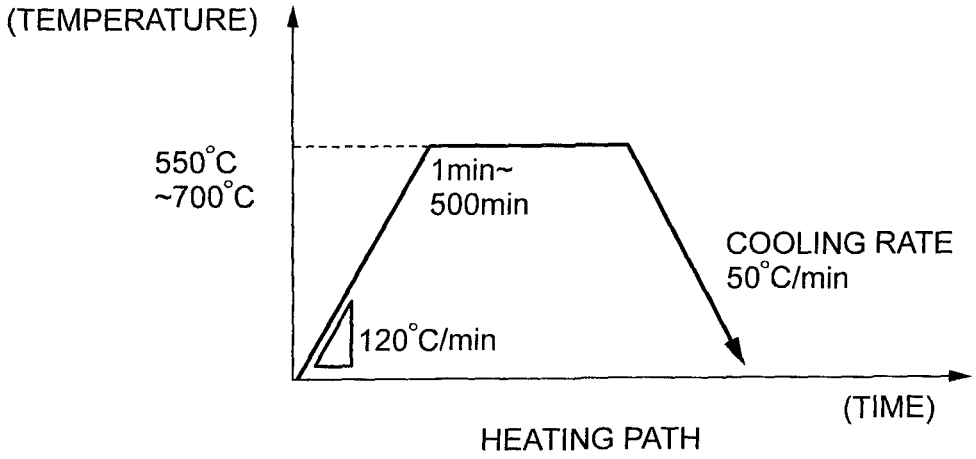
FIG. 5 is a diagram illustrating a heating path of the third step during the manufacture of test pieces of Examples 1 to 5 and Comparative Examples 1 to 3.
Figure 6:
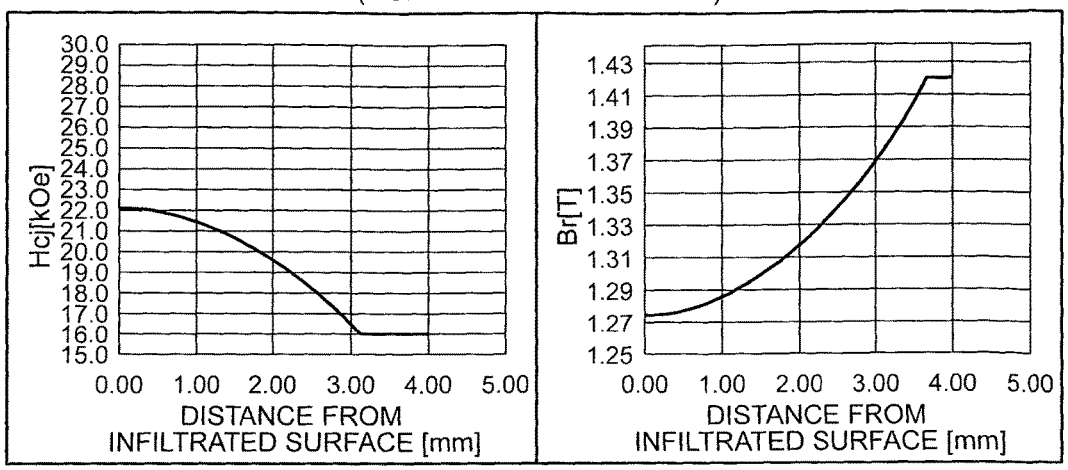
FIG. 6 is a diagram illustrating a distribution of magnetic properties of Comparative Example 1.
Figure 7:
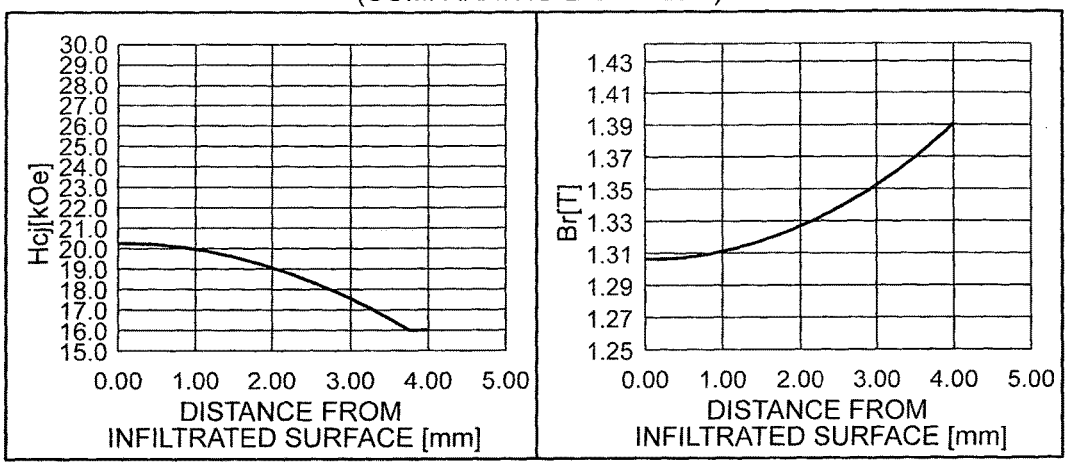
FIG. 7 is a diagram illustrating a distribution of magnetic properties of Comparative Example 2.
Figure 8:
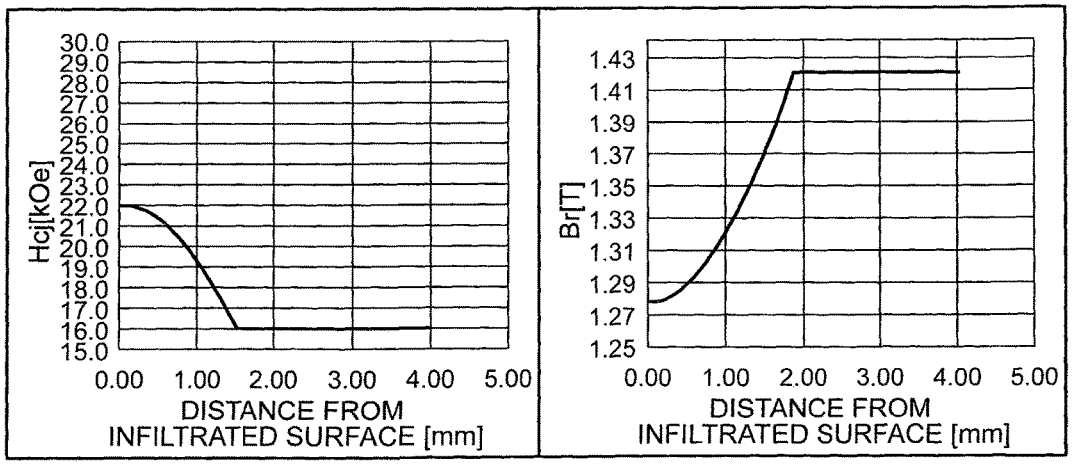
FIG. 8 is a diagram illustrating a distribution of magnetic properties of Comparative Example 3.
Figure 9:
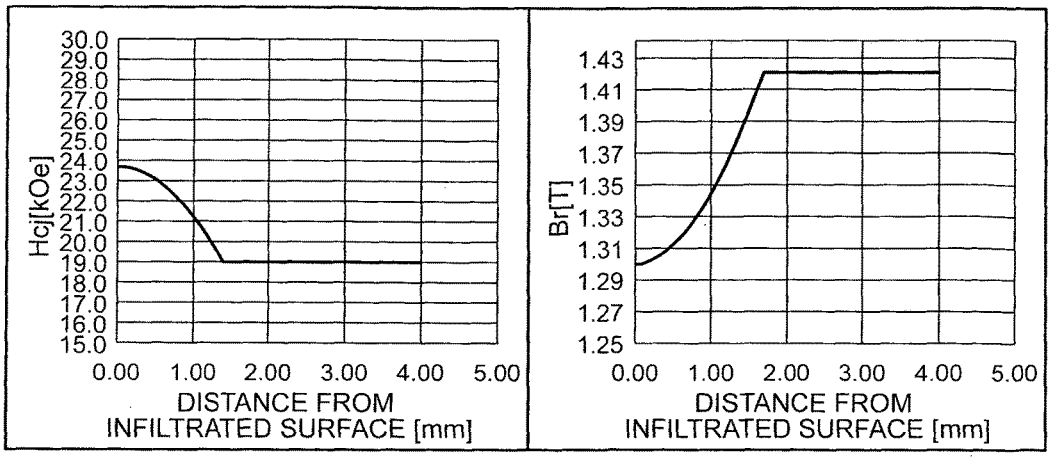
FIG. 9 is a diagram illustrating a distribution of magnetic properties of Example 1.
Figure 10:
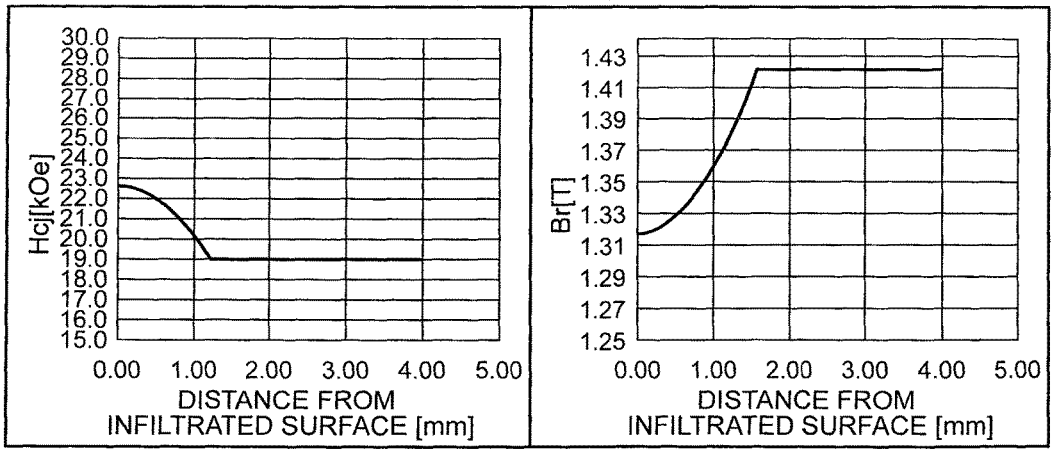
FIG. 10 is a diagram illustrating a distribution of magnetic properties of Example 2.
Figure 11:
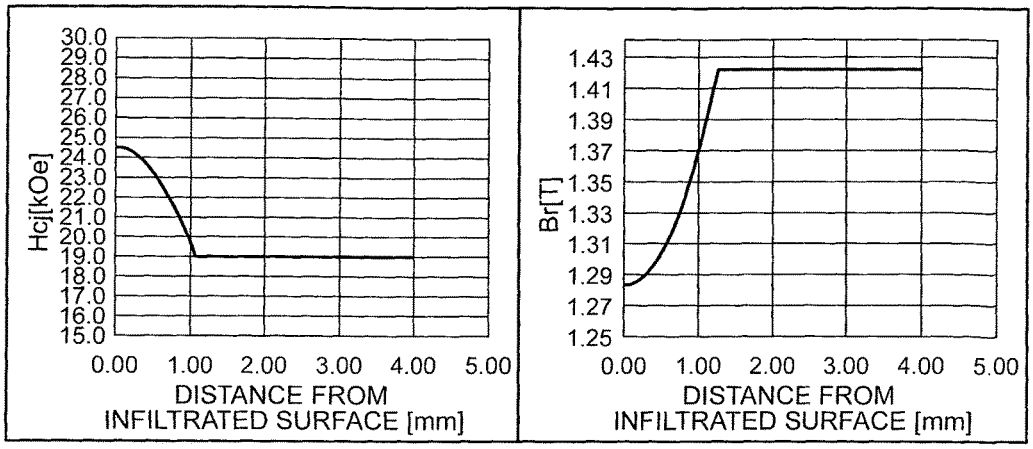
FIG. 11 is a diagram illustrating a distribution of magnetic properties of Example 3.
Figure 12:
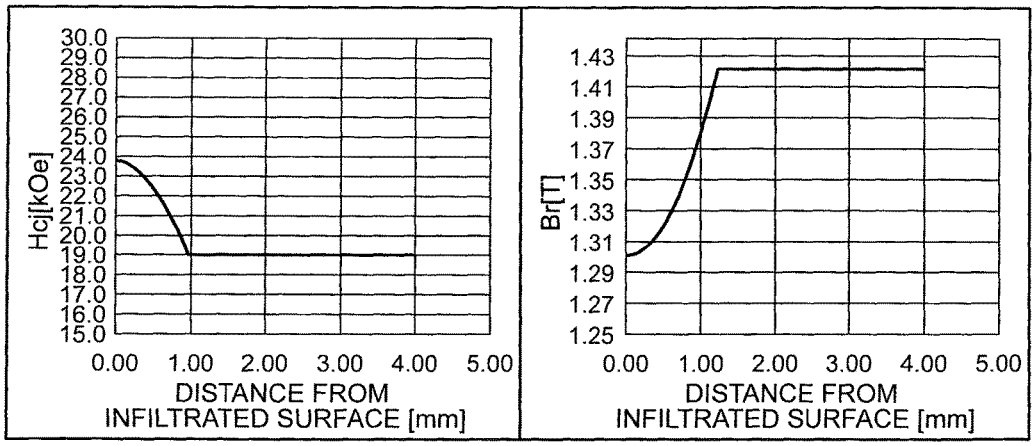
FIG. 12 is a diagram illustrating a distribution of magnetic properties of Example 4.
Figure 13:
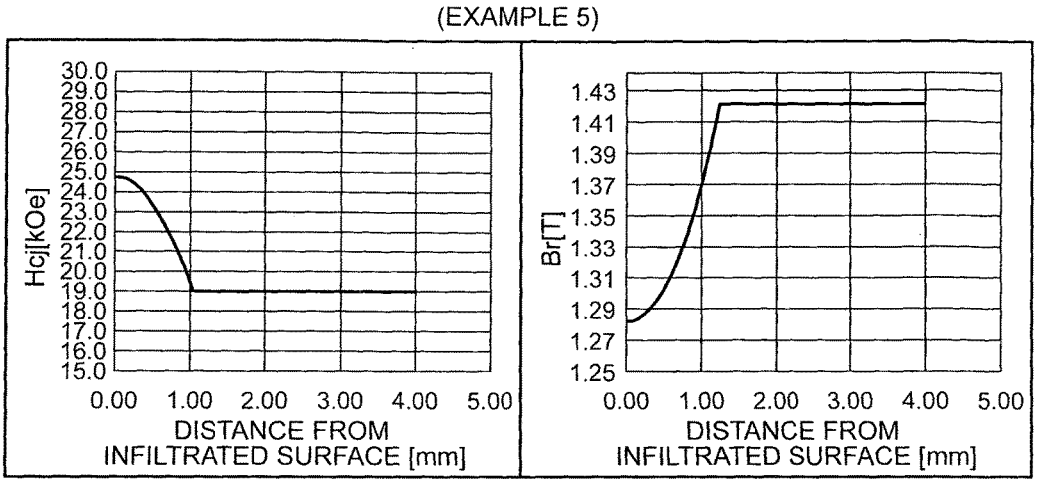
FIG. 13 is a diagram illustrating a distribution of magnetic properties of Example 5.

A liquid rapidly-solidified ribbon having a composition represented by $Nd_{28.9}Pr_{0.4}Fe_{ba1}B_{0.93}Ga_{0.4}Al_{0.1}Cu_{0.1}$ was prepared in a single-roll furnace, the obtained rapidly-solidified ribbon was sintered to prepare a sintered compact (sintering temperature: 650° C.; 400 MPa), and high deformation (processing temperature: 750° C.; processing degree: 75%) was performed on the sintered compact, thereby preparing a rare earth magnet precursor. The obtained rare earth magnet precursor was subjected to a heat treatment in which a Nd—Cu alloy was infiltrated thereinto according to a heating path illustrated in FIG. 5. As the modified alloy, a $Nd_{70}Cu_{30}$ alloy was used, and the thickness of the rare earth magnet precursor before the infiltration was 4 mm. The infiltration amount, the infiltration temperature, and the infiltration time of the Nd—Cu alloy varied in Examples 1 to 5 (refer to Table 1 below).

Comparative Examples 1 to 3

A liquid rapidly-solidified ribbon having a composition represented by $Nd_{30}Fe_{ba1}B_{0.9}$ was prepared in a single-roll furnace, the obtained rapidly-solidified ribbon was sintered to prepare a sintered compact (sintering temperature: 650° C.; 400 MPa), and high deformation (processing temperature: 750° C.; processing degree: 75%) was performed on the sintered compact, thereby preparing a rare earth magnet precursor. The obtained rare earth magnet precursor was subjected to a heat treatment in which a Nd—Cu alloy was infiltrated thereinto according to a heating path illustrated in FIG. 5. As the modified alloy, a $Nd_{70}Cu_{30}$ alloy was used, and the thickness of the rare earth magnet precursor before the infiltration was 4 mm. The infiltration amount, the infiltration temperature, and the infiltration time of the Nd—Cu alloy varied in Comparative Examples 1 to 3 (refer to Table 1 below).

The above test pieces were evaluated using a vibrating sample magnetometer (VSM) and a pulsed high field magnetometer (TPM) in addition to the infiltration amount, the infiltration temperature, and the infiltration time of the Nd—Cu alloy. The experiment results relating to the magnetic properties are shown in Table 1 below. In addition, the magnetic properties of Comparative Example 1 and Example 1 after high deformation are shown in Table 2. Further, distributions of the magnetic properties of Comparative Examples 1 to 3 and Examples 1 to 5 are shown in FIGS. 6 to 13, respectively.

(Experiment Results)

TABLE 1

| | Nd—Cu Infiltration Amount (%) | Infiltration Time (min) | Infiltration Temperature (° C.) | Surface Coercive Force (kOe) | Center Coercive Force (kOe) | Surface Remanent Magnetization (T) | Inside Remanent Magnetization (T) | Average Remanent Magnetization (T) |
|---|---|---|---|---|---|---|---|---|
| Comp. Ex. 1 | 10 | 240 | 650 | 22.1 | 19.7 | 1.27 | 1.32 | 1.33 |
| Comp. Ex. 2 | 5 | 500 | 650 | 20.2 | 19.0 | 1.31 | 1.33 | 1.34 |
| Comp. | 5 | 60 | 650 | 21.9 | 16.1 | 1.28 | 1.42 | 1.38 |

TABLE 1-continued

| | Nd—Cu Infiltration Amount (%) | Infiltration Time (min) | Infiltration Temperature (° C.) | Surface Coercive Force (kOe) | Center Coercive Force (kOe) | Surface Remanent Magnetization (T) | Inside Remanent Magnetization (T) | Average Remanent Magnetization (T) |
|---|---|---|---|---|---|---|---|---|
| Ex. 3 | | | | | | | | |
| Ex. 1 | 2 | 60 | 650 | 23.7 | 19.0 | 1.30 | 1.42 | 1.39 |
| Ex. 2 | 1 | 60 | 650 | 22.7 | 19.0 | 1.32 | 1.42 | 1.39 |
| Ex. 3 | 2 | 30 | 650 | 24.6 | 19.0 | 1.28 | 1.42 | 1.39 |
| Ex. 4 | 1 | 30 | 650 | 23.7 | 19.0 | 1.30 | 1.42 | 1.40 |
| Ex. 5 | 2 | 60 | 580 | 24.7 | 19.0 | 1.28 | 1.42 | 1.39 |

TABLE 2

| Magnetic Properties after High Deformation | | |
|---|---|---|
| | Coercive Force (kOe) | Remanent Magnetization (T) |
| Comparative Example 1 | 16.1 | 1.42 |
| Example 1 | 16.0 | 1.42 |

In Comparative Examples 1 to 3, the center coercive force was not recovered with only the heat treatment, and thus it was necessary that the Nd—Cu alloy be infiltrated into the center of the magnet. Therefore, the infiltration amount of the Nd—Cu alloy was required to be large, or the infiltration time was required to be long. Therefore, the remanent magnetization of the inside of the magnet and the average remanent magnetization were significantly decreased.

On the other hand, in Examples 1 to 5, the coercive force of the center region of the magnet was recovered to be 19 kOe or higher with only the heat treatment, and the following was found. The improvement of the coercive force by the infiltration of the Nd—Cu alloy was required only for the surface region of the magnet. That is, since the coercive force of the center region of the magnet was recovered to be 19 kOe or higher with only the heat treatment, the infiltration amount and the infiltration time of the Nd—Cu alloy can be made to be small and short, respectively. As a result, the remanent magnetization of the center region of the magnet was equal to the remanent magnetization of the magnet before the infiltration of the modified alloy, and the average remanent magnetization was also improved as compared to the comparative examples.

[Experiment for Verifying Temperature Dependence of Coercive Force, and Results Thereof]

The present inventors performed an experiment for verifying temperature dependence of coercive force of a rare earth magnet.

Example 6

Blocks having a size of 1 mm×1 mm were cut out from the surface region and the center region of the magnet of Example 2 to obtain a rare earth magnet according to Example 6.

Comparative Example 4

A block having a size of 1 mm×1 mm was cut out from the center portion of the magnet of Comparative Example 1 to obtain a rare earth magnet according to Comparative Example 4.

Comparative Example 5

Figure 14:
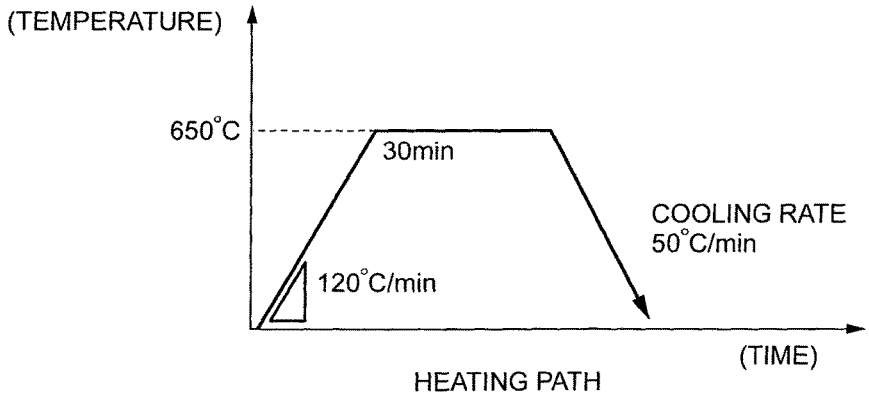
FIG. 14 is a diagram illustrating a heating path of the third step during the manufacture of test pieces of Example 6 and Comparative Examples 4 and 5.

A liquid rapidly-solidified ribbon having a composition represented by $Nd_{28.9}Pr_{0.4}Fe_{ba1}B_{0.93}Ga_{0.4}Al_{0.1}Cu_{0.1}$ was prepared in a single-roll furnace, the obtained rapidly-solidified ribbon was sintered to prepare a sintered compact (sintering temperature: 650° C.; 400 MPa), and high deformation (processing temperature: 750° C.; processing degree: 75%) was performed on the sintered compact, thereby preparing a rare earth magnet precursor. The obtained rare earth magnet precursor was subjected to a heat treatment (the thickness of the magnet in the optimization treatment was 4 mm) according to a heating path illustrated in FIG. 14. As a result, a rare earth magnet according to Comparative Example 5 was obtained.

(Experiment Results)

Figure 15:
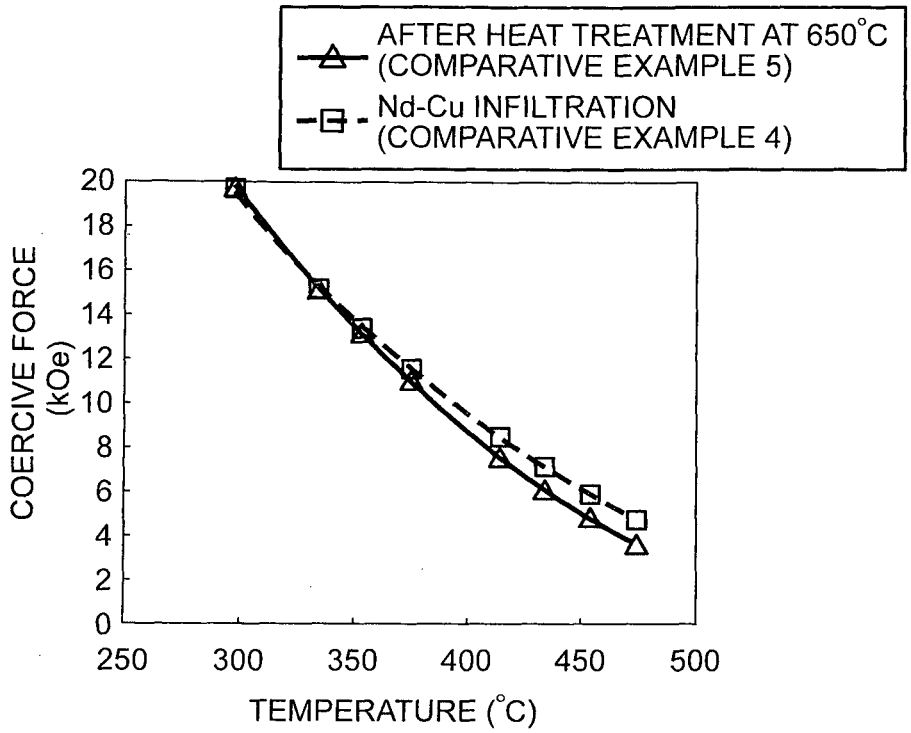
FIG. 15 is a diagram illustrating a relationship between a temperature and a coercive force in Comparative. Examples 4 and 5.
Figure 16:
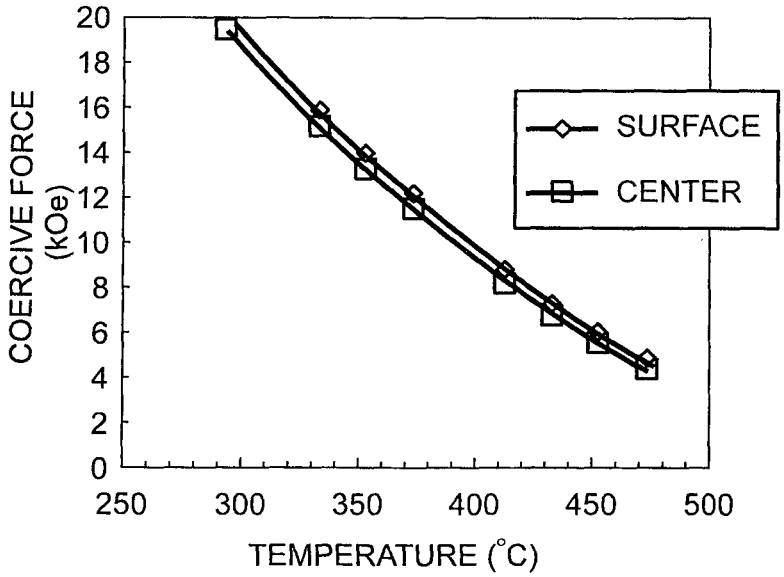
FIG. 16 is a diagram illustrating a relationship between a temperature and a coercive force in a surface region and a center region of Example 6.

Regarding the experiment results, FIG. 15 is a diagram illustrating a relationship between a temperature and a coercive force in Comparative Examples 4 and 5. FIG. 16 is a diagram illustrating a relationship between a temperature and a coercive force in a surface region and a center region of Example 6. In addition, FIG. 17 is a diagram illustrating a decrease ratio of the coercive force of a rare earth magnet after a heat treatment to the coercive force of a rare earth magnet precursor before the heat treatment.

It was found from FIG. 15 that, in Comparative Example 4 in which a large amount of the Nd—Cu alloy was infiltrated, the coercive force was significantly decreased along with an increase in temperature. On the other hand, it was found from FIG. 16 that, in Example 6, the coercive force of the center region of the magnet was not substantially decreased along with an increase in temperature.

Figure 17:
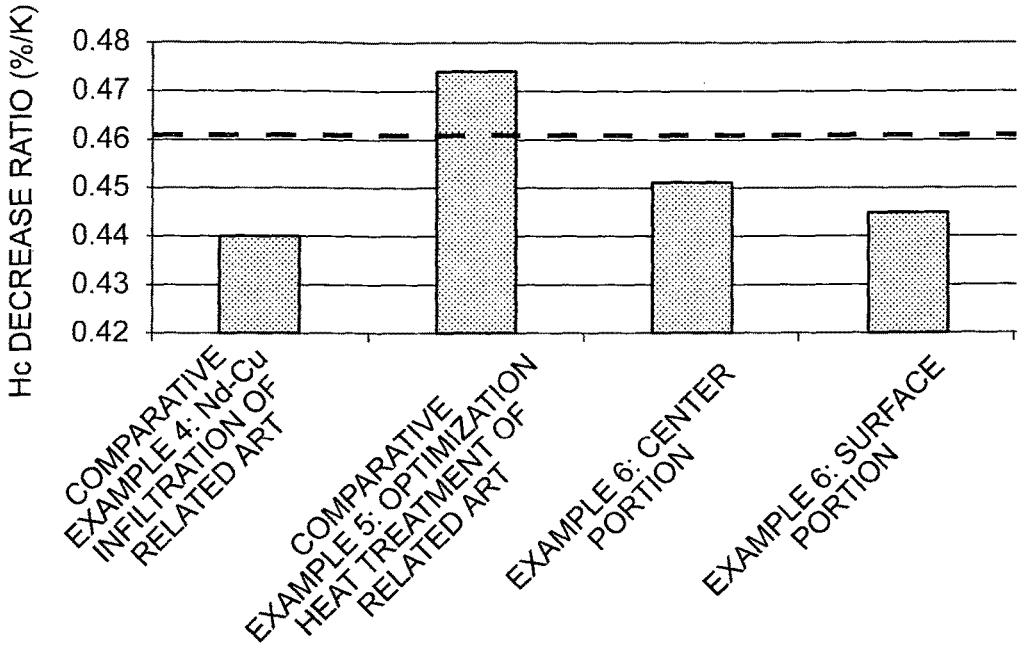
FIG. 17 is a diagram illustrating a decrease ratio of the coercive force of a rare earth magnet after a heat treatment to the coercive force of a rare earth magnet precursor before the heat treatment.

In addition, the following was found from FIG. 17. In the center portion (center region) of Example 6, according to the infiltration amount of the Nd—Cu alloy and the heat treatment holding time of Example 6, the Nd—Cu alloy was not sufficiently infiltrated thereinto, and the coercive force was improved by the effect of the optimization heat treatment. On the other hand, when Example 6 was compared to Comparative Example 5, it was found that a decrease ratio of the coercive force was improved (FIG. 17 illustrates that the lower the Hc decrease ratio, the better). This result indicates that the isolation of the grain boundary phase is improved by a combination of the heat treatment with the infiltration of the Nd—Cu alloy. In addition, when the surface portions (surface regions) of Comparative Example 4 and Example 6 were compared to each other, the Hc decrease ratios of both Comparative Example 4 and Example 6 were low and superior. This result indicates that, even when the infiltration amount of the modified alloy is smaller and the infiltration time is shorter than those of Comparative Example 4, the coercive force decrease effect was low to the same extent as in Comparative Example 4.

[Experiment for Verifying Appropriate Range of Infiltration Amount of Modified Alloy and Experiment for Verifying Appropriate Range of Heat Treatment Holding Time During Diffusion and Infiltration of Modified Alloy, and Results Thereof]

The present inventors performed an experiment for verifying an appropriate range of the infiltration amount of a modified alloy and an experiment for verifying an appropriate range of a heat treatment holding time during the diffusion and infiltration of a modified alloy.

Figure 18:
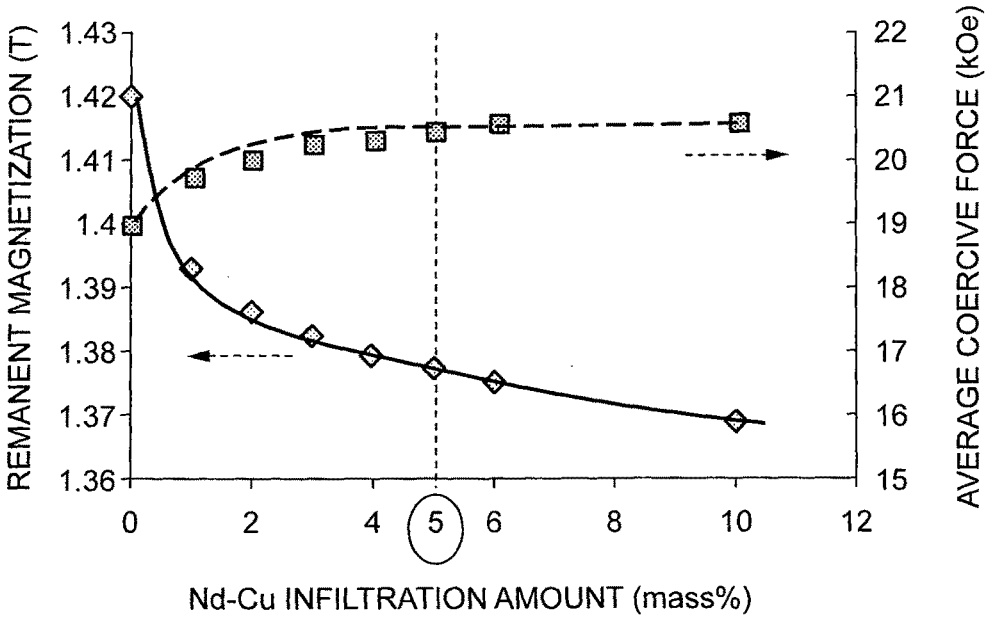
FIG. 18 is a diagram illustrating the experiment results of verifying an appropriate range of the infiltration amount of a modified alloy.

As the modified alloy, a Nd—Cu alloy was used, and rare earth magnets were prepared while changing the infiltration amount of the Nd—Cu alloy to 0 mass %, 1 mass %, 2 mass %, 3 mass %, 4 mass %, 5 mass %, 6 mass %, and 10 mass %. The remanent magnetization and the coercive force of each of the rare earth magnets was measured. The results are shown in FIG. 18. In addition, rare earth magnets were prepared while changing the holding time during the heat treatment of the Nd—Cu alloy in a range of 0 minutes to 300 minutes. The remanent magnetization and the coercive force of each of the rare earth magnets was measured. The results are shown in FIG. 19.

First, in FIG. 18, the infiltration amount of the Nd—Cu alloy was represented by a mass ratio thereof to the mass of the rare earth magnet precursor to be infiltrated. The following was verified from FIG. 18. Along with an increase in the infiltration amount of the Nd—Cu alloy, the remanent magnetization had an inflection point at an infiltration amount of 1 mass % and tended to decrease, and the coercive force had an inflection point at an infiltration amount of 1 mass % and tended to increase. In consideration of the decrease tendency of the remanent magnetization and a saturated value of the coercive force, a preferable range of the infiltration amount of the Nd—Cu alloy was set to be more than 0 mass % and less than 5 mass %. As shown in Examples 1 to 5, the infiltration amount of the melt of the modified alloy may be at least 1 mass % and at most 2 mass % with respect to the rare earth magnet precursor.

Figure 19:
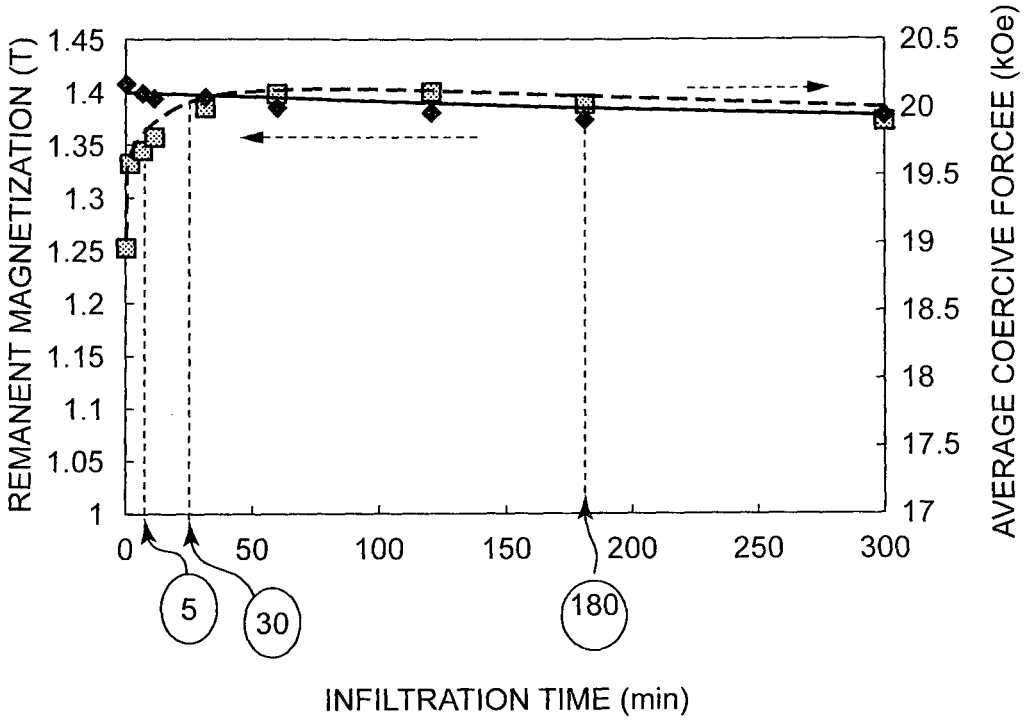
FIG. 19 is a diagram illustrating the experiment results of verifying an appropriate range of a heat treatment holding time during the diffusion and infiltration of a modified alloy.

In addition, the following was found from FIG. 19. Regarding the infiltration time of the modified alloy (the holding time during the heat treatment), the coercive force had an inflection point at an infiltration time of 5 minutes, had a peak value at an infiltration time of 30 minutes, and then tended to slightly decrease. The remanent magnetization slightly decreased along with an increase in the infiltration time. Therefore, the holding time during the heat treatment was preferably 5 minutes to 180 minutes, more preferably 30 minutes to 180 minutes, and still more preferably about 30 minutes.

It was found that a rare earth magnet which is superior in both magnetization performance and coercive force performance can be manufactured by performing the heat treatment under the following conditions: in the infiltration amount range of the modified alloy obtained by the above experiment; in the holding time range during the heat treatment obtained by the above experiment; and in a temperature range of 450° C. to 700° C. in which the modified alloy can be diffused and infiltrated and the elements present in the grain boundary phase can be alloyed.

Hereinabove, the embodiment of the invention have been described with reference to the drawings. However, a specific configuration is not limited to the embodiment, and design changes and the like which are made within a range not departing from the scope of the invention are included in the invention.

The invention claimed is:

1. A method of manufacturing a rare earth magnet comprising:

manufacturing a sintered compact which has a composition represented by $(Rl)_x(Rh)_yT_zB_sM_t$ and has a structure including a main phase and a grain boundary phase;

manufacturing a rare earth magnet precursor by performing hot deformation processing on the sintered compact, and manufacturing a rare earth magnet by performing a heat treatment on the rare earth magnet precursor in a temperature range of 450° C. to 700° C. so as to diffuse and to infiltrate a melt of a modified alloy into a surface region of the grain boundary phase of the rare earth magnet precursor, the modified alloy containing a light rare earth element and one of a transition metal element, Al, In, Zn, and Ga, wherein Rl represents at least one of light rare earth element or Y, Rh represents Dy or Tb, T represents a transition metal and T is at least one of Fe, Ni, and Co, B represents boron, M represents at least one of Ga, Al, and Cu, x, y, z, s, and t respectively represent percentages by mass of Rl, Rh, T, B, and M in the sintered compact, x, y, z, s, and t are expressed by the following expressions: 27 an infiltration amount of the melt of the modified alloy infiltrated into the surface region of the grain boundary phase is more than 0 mass % and less than 5 mass % with respect to the rare earth magnet precursor, and the surface region is defined as a depth of up to 2a/3 where a represents a distance from a surface to a center of the rare earth magnet.

2. The method according to claim 1, wherein a holding time during the heat treatment is 5 minutes to 3 hours.

3. The method according to claim 2, wherein the holding time during the heat treatment is 30 minutes to 3 hours.

4. The method according to claim 1, wherein the modified alloy has at least one of a melting point and an eutectic point in the temperature range of 450° C. to 700° C., and the modified alloy is an alloy containing at least one of Nd and Pr and one of Cu, Co, Mn, In, Zn, Al, Ag, Ga, and Fe.

5. The method according to claim 1, wherein the infiltration amount of the melt of the modified alloy is at least 1 mass % and at most 2 mass % with respect to the rare earth magnet precursor.

* * * * *